US011798351B2

(12) United States Patent
Kazama et al.

(10) Patent No.: US 11,798,351 B2
(45) **Date of Patent: *Oct. 24, 2023**

(54) GAMING MACHINE, GAMING SYSTEM, DISPLAY METHOD AND PROGRAM

(71) Applicant: Konami Gaming, Inc., Las Vegas, NV (US)

(72) Inventors: Narumi Kazama, Zama (JP); Hironobu Hayashi, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/983,291

(22) Filed: Nov. 8, 2022

(65) Prior Publication Data

US 2023/0177912 A1 Jun. 8, 2023

Related U.S. Application Data

(63) Continuation of application No. 17/147,277, filed on Jan. 12, 2021, now Pat. No. 11,521,456, which is a (Continued)

(30) Foreign Application Priority Data

Oct. 5, 2018 (JP) ..... 2018-190135

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... G07F 17/3213; G07F 17/34
(Continued)

(56) References Cited

U.S. PATENT DOCUMENTS 8,137,182 B2 3/2012 Kearns et al.
8,384,710 B2 2/2013 Schlottmann et al.
(Continued)

FOREIGN PATENT DOCUMENTS

WO 2017/213821 A1 12/2017

*Primary Examiner* — Allen Chan
(74) *Attorney, Agent, or Firm* — Howard & Howard Attorneys PLLC

(57) ABSTRACT

A plurality of gaming machines to perform an integrated operation in cooperation with one another is provided. A gaming machine constituting a group of gaming machines includes a display that displays a game screen including predetermined computer graphics cooperated with the other gaming machines included in the group of gaming machines, a storage device that stores a gaming machine identifier, common graphic data, and a plurality of virtual camera coordinates associated with identifiers, and a controller, and the controller constructs a three-dimensional model in common with the other gaming machines on the basis of a timer value synchronized by communicating with the other gaming machines and the common graphic data, and configures the predetermined computer graphics by performing perspective transformation on the three-dimensional model using the virtual camera coordinates associated with the identifier as a point of view, and causes the predetermined computer graphics to be displayed on the display.

20 Claims, 14 Drawing Sheets

Related U.S. Application Data continuation of application No. 16/586,456, filed on Sep. 27, 2019, now Pat. No. 11,151,832.

(58) Field of Classification Search
USPC ..... 463/20
See application file for complete search history.

(56) References Cited

U.S. PATENT DOCUMENTS

| | | | | |
|---|---|---|---|---|
| 8,419,520 | B2 * | 4/2013 | Johnson | G07F 17/32 463/16 |
| 8,550,898 | B2 | 10/2013 | Kearns et al. | |
| 8,968,088 | B2 | 3/2015 | Brunell et al. | |
| 9,070,249 | B2 * | 6/2015 | Radek | G07F 17/3283 |
| 2012/0178523 | A1 | 7/2012 | Greenberg et al. | |
| 2014/0080556 | A1 | 3/2014 | Knutsson | |
| 2017/0080343 | A1 | 3/2017 | Tamakawa et al. | |

* cited by examiner

GAMING MACHINE, GAMING SYSTEM, DISPLAY METHOD AND PROGRAM

CROSS-REFERENCE TO RELATED APPLICATION

This application is a continuation of U.S. patent application Ser. No. 17/147,277, filed Jan. 12, 2021, which is a continuation of U.S. patent application Ser. No. 16/586,456, filed Sep. 27, 2019 (now U.S. Pat. No. 11,151,832, issued Oct. 19, 2021), which claims priority to Japanese Patent Application No. 2018-190135, filed Oct. 5, 2018, the disclosures of which are hereby incorporated by reference in their entirety.

TECHNICAL FIELD

Embodiments of the present disclosure relate to a gaming machine, a gaming system, a display method, and a program.

BACKGROUND OF THE INVENTION

Patent Literature 1 discloses a gaming machine group including gaming machines which are communicably connected to one another. The gaming machine group includes a master gaming machine and slave gaming machines other than the master gaming machine. The respective gaming machines are connected in series starting with the master gaming machine. The master gaming machine outputs a timer reset signal to the slave gaming machines. The slave gaming machines reset their timers using the acquired reset signal. In the gaming machines included in the gaming machine group, it is possible to perform synchronized operations between the gaming machines using a timer (common timer) synchronized by reset. For example, when illuminations using an LED are used in the gaming machines, it is possible to cause the illuminations in a plurality of gaming machines to emit light in synchronization with one another.

Further, each of the gaming machines that constitute the gaming machine group can be assigned with a machine ID for determining a position of its own housing from the beginning. The gaming machines included in the gaming machine group can also perform an operation with a time difference between the gaming machines using the machine ID and the common timer described above.

Citation List: Patent Literature, Patent Literature 1: International Patent Publication No. 2017/213821

SUMMARY OF INVENTION

Technical Problem

According to the synchronized operation between a plurality of gaming machines or the operation with the time difference between the gaming machines, it is possible to provide a form that is more appealing to the players than when the gaming machines are operated individually. However, there is room for improvement from the viewpoint of providing a form that is more appealing to the players.

The present disclosure provides a technique that enables a plurality of gaming machines to perform an integrated operation in cooperation with one another.

Solution to Problem

In one aspect of the present disclosure, a gaming machine that constitutes a group of gaming machines that are communicably connected to each other is provided. The gaming machine includes a display, a storage device, and a controller. The display displays a game screen including predetermined computer graphics cooperated with the other gaming machines included in the group of gaming machines. The storage device stores an identifier assigned to the gaming machine, common graphic data for displaying the predetermined computer graphics, and a plurality of virtual camera coordinates associated with each of the identifiers assignable to the gaming machine. The controller is connected to the display and the storage device. The controller constructs a three-dimensional model in common with the other gaming machines included in the group of gaming machines on the basis of a timer value synchronized by communicating with the other gaming machines included in the group of gaming machines and the common graphic data stored in the storage device. The controller configures the predetermined computer graphics by performing perspective transformation on the three-dimensional model using the virtual camera coordinates associated with the identifier assigned to the gaming machine as a point of view, and causes the predetermined computer graphics to be displayed on the display.

According to the gaming machine according to one aspect of the present disclosure, the three-dimensional model in common with the other gaming machines included in the group of gaming machines is constructed on the basis of the timer value synchronized by communicating with the other gaming machines included in the group of gaming machines and the common graphic data stored in the storage device. Further, the predetermined computer graphics cooperated with the other gaming machines included in the group of gaming machines is configured by performing the perspective transformation on the three-dimensional model using the virtual camera coordinates associated with the identifier assigned to the gaming machine as the point of view and displayed on the display. As described above, the same scene as the scenes displayed on the displays by the other gaming machines is displayed temporally and spatially in cooperation with the other gaming machines from a different point of view from those of the other gaming machines. In other words, the display can be performed as if the display of the gaming machine were linked with the displays of the other gaming machines. For this reason, it is possible to display a powerful scene straddling the display of the gaming machine and the displays of the other gaming machines. Therefore, the gaming machine according to one aspect of the present disclosure can perform the integrated operation in cooperation with a plurality of gaming machines.

In one embodiment, the plurality of virtual camera coordinates associated with each of the identifiers assignable to the gaming machine may be located on the same straight line in a three-dimensional space. According to this configuration, when an object moving parallel to the same straight line in the three-dimensional space is rendered, the distance from the point of view of the gaming machine to the object and the distances from the points of view of the other gaming machines to the object can be set to be equal. Therefore, the gaming machine can display the object moving parallel to the same straight line in cooperation with a plurality of the gaming machines.

In one embodiment, the plurality of virtual camera coordinates associated with each of the identifiers assignable to the gaming machine may be located on the same straight line at equal intervals. According to this configuration, when an object moving parallel to the same straight line is rendered, the point of view of the gaming machine and the points of view of the other gaming machines can be located at equal intervals. The gaming machines are generally arranged at equal intervals. For this reason, the arrangement interval of the gaming machine can be associated with the arrangement interval of the point of view in the three-dimensional space. Therefore, the gaming machine can display the object more naturally when displaying the object moving parallel to the same straight line in cooperation with a plurality of the gaming machines.

In one embodiment, a projection plane having the virtual camera coordinates associated with the identifier assigned to the gaming machine as the point of view may be adjacent to a projection plane having the virtual camera coordinates associated with identifiers assigned to the other gaming machines included in the group of gaming machines as the point of view in a three-dimensional space. According to this configuration, the gaming machine can perform the display as if the display of the gaming machine and the displays of the other gaming machines were one display. Accordingly, it is possible to display a powerful object straddling the display of the gaming machine and the displays of the other gaming machines.

In one embodiment, the camera coordinates associated with the identifier assigned to the gaming machine may be moved while maintaining a predetermined positional relation with the virtual camera coordinates associated with identifiers assigned to the other gaming machines included in the group of gaming machines. According to this configuration, since it is possible to photograph an object with a desired camera work while maintaining a relative positional relation of a plurality of virtual cameras, it is possible to display a dynamic scene straddling the display of the gaming machine and the displays of the other gaming machines.

In one embodiment, the predetermined computer graphics cooperated with the other gaming machines included in the group of gaming machines may be an animation in which an object moves. According to this configuration, it is possible to display an object moving across the display of the gaming system and the displays of the other gaming machines.

In one embodiment, the game screen may include a plurality of cells arranged in a grid form, and the controller may randomly determine symbols to be arranged in the plurality of cells and perform winning determination in accordance with a combination of the symbols displayed on the display. In this case, it is possible to display predetermined computer graphics cooperated with the other gaming machines on the game screen along with a slot game.

In another aspect of the present disclosure, a gaming system including a plurality of gaming machines that are communicably connected to each other is provided. Each of the plurality of gaming machines includes a display, a storage device, and a controller. The display displays a game screen including predetermined computer graphics cooperated with the other gaming machines included in the gaming system. The storage device stores an identifier assigned to the gaming machine, common graphic data for displaying the predetermined computer graphics, and a plurality of virtual camera coordinates associated with each of identifiers assignable to the gaming machine. The controller is connected to the display and the storage device. The controller constructs a three-dimensional model in common with the other gaming machines included in the gaming system on the basis of a timer value synchronized by communicating with the other gaming machines included in the gaming system and the common graphic data stored in the storage device. The controller configures the predetermined computer graphics by performing perspective transformation on the three-dimensional model using the virtual camera coordinates associated with the identifier assigned to the gaming machine as a point of view, and causes the predetermined computer graphics to be displayed on the display.

According to the gaming system according to one aspect of the present disclosure, in each of the plurality of gaming machines, the three-dimensional model in common with the other gaming machines included in the gaming system is constructed on the basis of the timer value synchronized by communicating with the other gaming machines included in the gaming system and the common graphic data stored in the storage device. Further, the predetermined computer graphics cooperated with the other gaming machines included in the gaming system is configured by performing the perspective transformation on the three-dimensional model using the virtual camera coordinates associated with the identifier assigned to the gaming machine as a point of view and displayed on the display. As described above, the same scene is displayed in a temporally and spatially cooperative manner from a different point of view in each of the plurality of gaming machines. In other words, the display can be performed as if the displays of the plurality of gaming machines were linked with each other. Accordingly, it is possible to display a powerful scene straddling the displays of the plurality of gaming machines. Therefore, the gaming system according to one aspect of the present disclosure can perform the integrated operation in cooperation with a plurality of gaming machines.

In another aspect of the present disclosure, a display method in a gaming machine that constitutes a group of gaming machines that are communicably connected to each other is provided. The display method includes a step of constructing a three-dimensional model in common with the other gaming machines included in the group of gaming machines on the basis of a timer value synchronized by communicating with the other gaming machines included in the group of gaming machines and common graphic data which is acquired in advance and a step of configuring predetermined computer graphics cooperated with the other gaming machines included in the group of gaming machines by performing perspective transformation on the three-dimensional model using virtual camera coordinates associated with an identifier assigned to the gaming machine as a point of view, and causes the predetermined computer graphics to be displayed on a display. According to this display method, the same effects as in the gaming machine described above are obtained.

In another aspect of the present disclosure, a program that operates a gaming machine that constitutes a group of gaming machines that are communicably connected to each other is provided. The gaming machine includes a display, a storage device, and a controller. The display displays a game screen including predetermined computer graphics cooperated with the other gaming machines included in the group of gaming machines. The storage device stores an identifier assigned to the gaming machine, common graphic data for displaying the predetermined computer graphics, and a plurality of virtual camera coordinates associated with each of identifiers assignable to the gaming machine. The controller is connected to the display and the storage device. The program causes the controller to perform an operation of constructing a three-dimensional model in common with the other gaming machines included in the group of gaming machines on the basis of a timer value synchronized by communicating with the other gaming machines included in the group of gaming machines and the common graphic data stored in the storage device. The program causes the controller to perform an operation of configuring the predetermined computer graphics by performing perspective transformation on the three-dimensional model using the virtual camera coordinates associated with the identifier assigned to the gaming machine as a point of view and causing the predetermined computer graphics to be displayed on the display. According to this program, the same effects as in the gaming machine described above are obtained.

Advantageous Effects of Invention

According to the present disclosure, a plurality of gaming machines can perform an integrated operation in cooperation with one another.

DETAILED DESCRIPTION OF INVENTION

Figure 1:
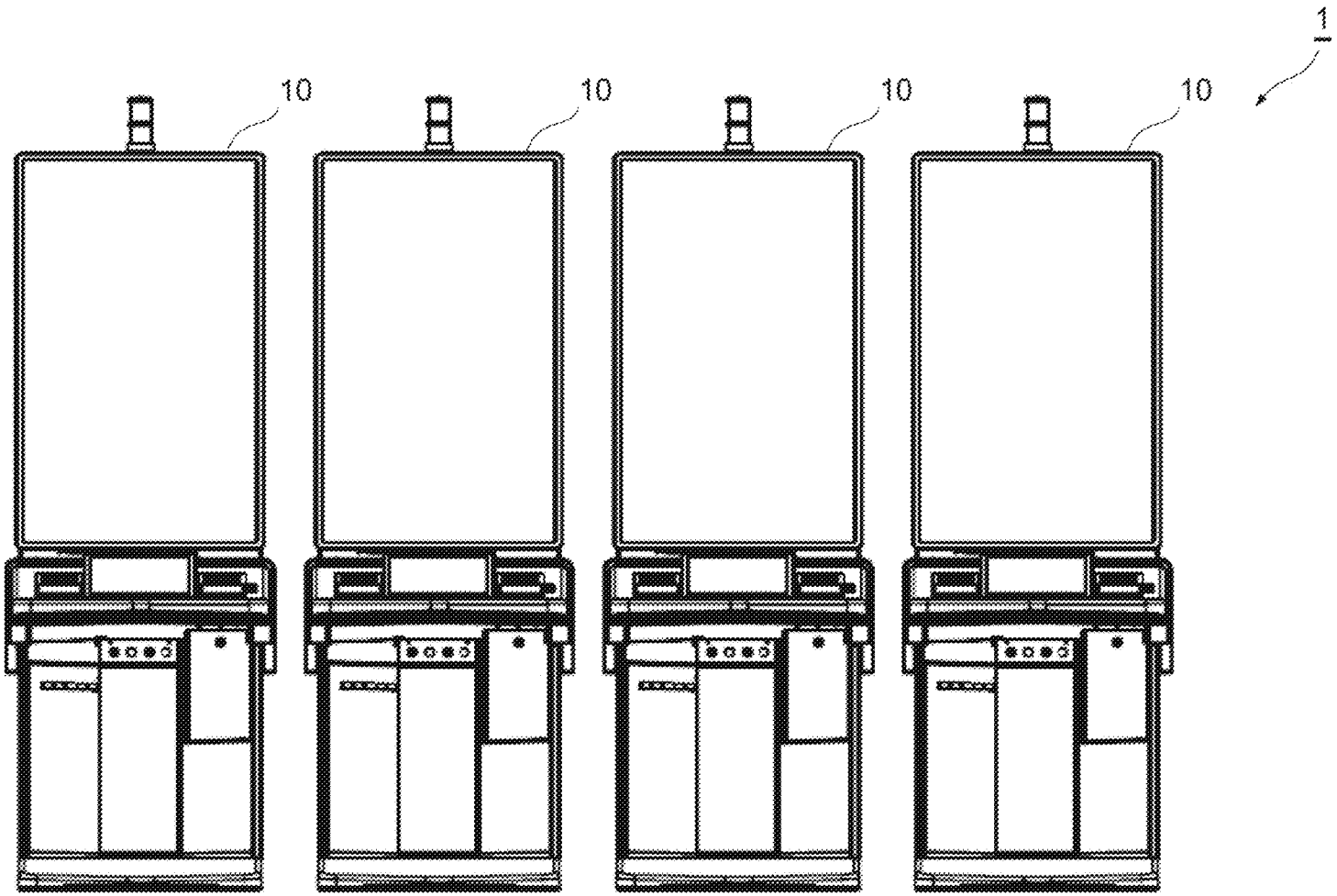
FIG. 1 is a front view illustrating an example of a gaming machine group.

Hereinafter, exemplary embodiments will be described in detail with reference to the accompanying drawings. In the drawings, the same or corresponding parts are denoted by the same reference numerals, and redundant description is omitted. The present disclosure relates to a gaming system, a gaming machine, a display method, and a gaming machine program as illustrated in the drawings and operation.

FIG. 1 is a front view illustrating an example of a gaming machine group. As illustrated in FIG. 1, a gaming machine group 1 includes a plurality of gaming machines 10. The plurality of gaming machines 10 are arranged on a casino floor to be adjacent to one another and are installed, for example, as a row of banks. The plurality of gaming machines 10 are arranged, for example, at regular intervals. Although FIG. 1 illustrates an example in which four gaming machines 10 constitute one gaming machine group 1, the number of gaming machines is not limited to four and may be more than one, for example, four or more or less than four.

Figure 2:
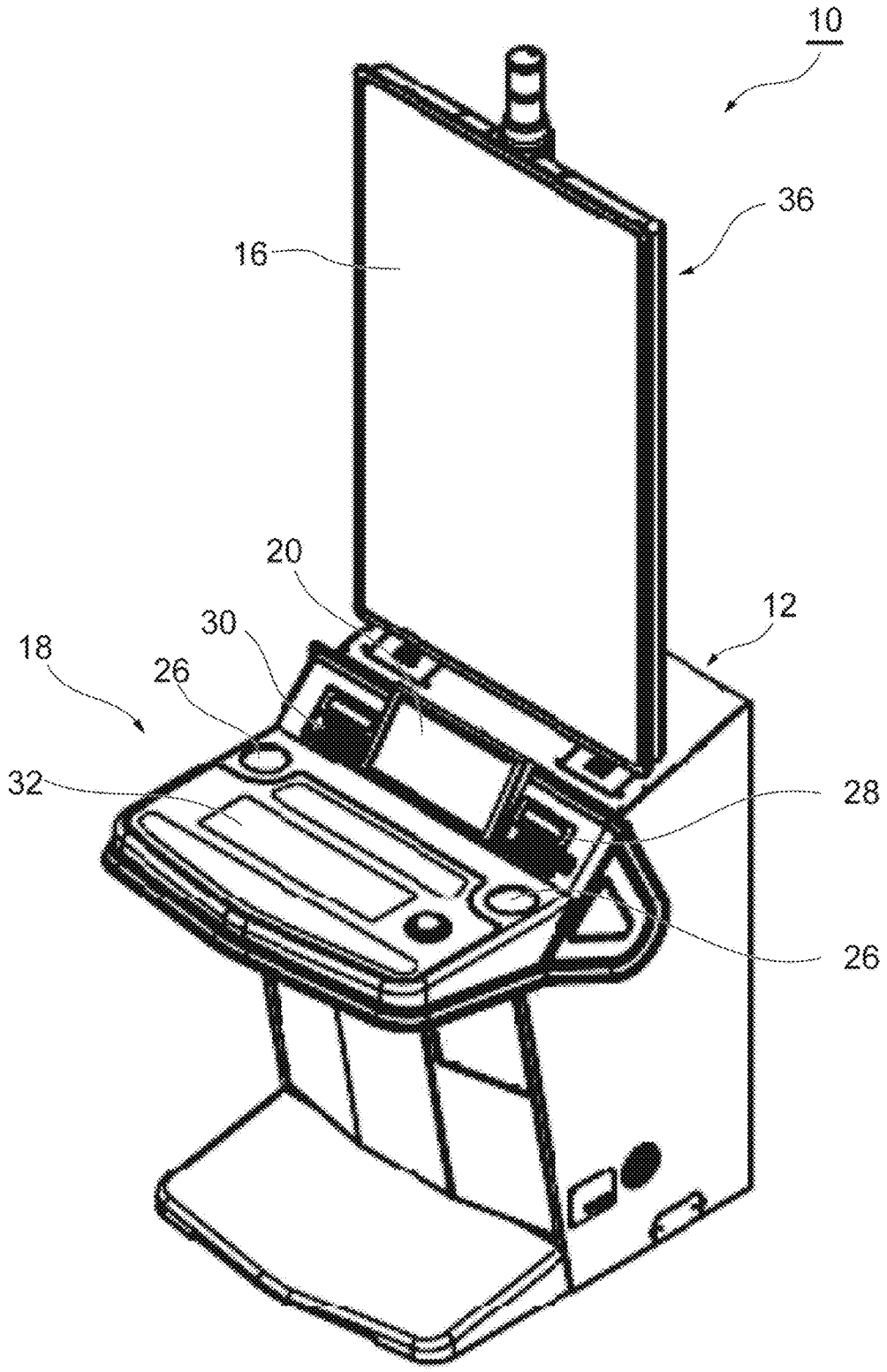
FIG. 2 is a perspective view illustrating an example of a gaming machine according to an embodiment.

FIG. 2 is a perspective view illustrating an example of a gaming machine according to an embodiment. The gaming machine 10 illustrated in FIG. 2 can receive a predetermined game value from a player, generate a game result, and provide a dividend to the player in accordance with the game result and a paytable.

As illustrated in FIG. 2, the gaming machine 10 includes a display 16 and a cabinet 12. The cabinet 12 also accommodates a controller 22 (see FIG. 3) that controls the components of the gaming machine 10.

The display 16 is a flat panel display device such as a liquid crystal display device or an organic EL display device. The display 16 provides a game screen to the player under the control of the controller 22. As will be described later, the display 16 displays a game screen including predetermined computer graphics cooperated with other gaming machines included in the gaming machine group 1. An illumination 36 may be disposed around the display 16 to provide decorative lighting.

The cabinet 12 is arranged below the display 16. A control panel 18 is disposed in the cabinet 12 such that it protrudes forward in the front of the cabinet 12. The control panel 18 includes a player tracking unit 20, a speaker 26, a bill/ticket identification unit 28, a printer unit 30, and an operation unit 32.

The player tracking unit 20 includes a card reader that recognizes a player identification card, a display that presents data to the player, and a keypad that receives an input from the player. The player tracking unit 20 operates in cooperation with the controller 22 or an external system to read information recorded in the player identification card inserted into the card reader by the player and displays the information and/or information acquired by communicating with the external system on the display. Further, the input from the player is received by the keypad, a display is changed in accordance with the input, and communication with the external system is executed if necessary.

The speaker 26 is disposed on each of the right and left sides of the control panel 18. The speaker 26 provides a sound to the player under the control of the controller 22.

The bill/ticket identification unit 28 can be accommodated in the cabinet 12 in a state in which an insertion opening into which a bill/ticket is inserted is exposed. An identification unit that identifies a bill/ticket with various types of sensors is disposed in the insertion slot. A bill/ticket storage unit is disposed on an output port side of the identification unit. The bill/ticket identification unit 28 receives a bill/ticket (including a voucher and a coupon) that is a game value, identifies it as a game value, and notifies controller 22 of it.

The printer unit 30 can be accommodated in the cabinet 12 in a state in which the ticket output port from which the ticket is output is exposed. A printing unit that prints prescribed information on a printing paper is disposed in the ticket output port, and an accommodating unit that accommodates printing paper is disposed on a paper inlet side of the printing unit. The printer unit 30 prints information on paper under the control of the controller 22, and outputs the ticket from the gaming machine 10 in accordance with a credit payout process. When the output ticket is inserted into the bill/ticket identification unit 28 of another gaming machine, the paid-out credit can be used for the game play, or the output ticket can be converted into money by a kiosk terminal in a casino or a casino cage.

The operation unit 32 receives an operation from the player. The operation unit 32 includes a group of buttons that receive various instructions from the player of the gaming machine 10. For example, the operation unit 32 may include a spin button and a group of setting buttons. The spin button receives an instruction to start an instance of a game (start spin of a reel). The group of setting buttons includes a group of bet buttons, a group of line designation buttons, a max bet button, a payout button, and the like. The group of bet buttons receives an instruction operation regarding a bet credit amount (a bet amount) from the player. The group of line designation buttons receives an instruction operation to designate a payline related to line determination to be described later from the player. The max bet button receives an instruction operation regarding a maximum credit amount that the player can bet on at one time. The payout button receives an instruction operation to instruct payout of a credit accumulated in the gaming machine 10.

Figure 3:
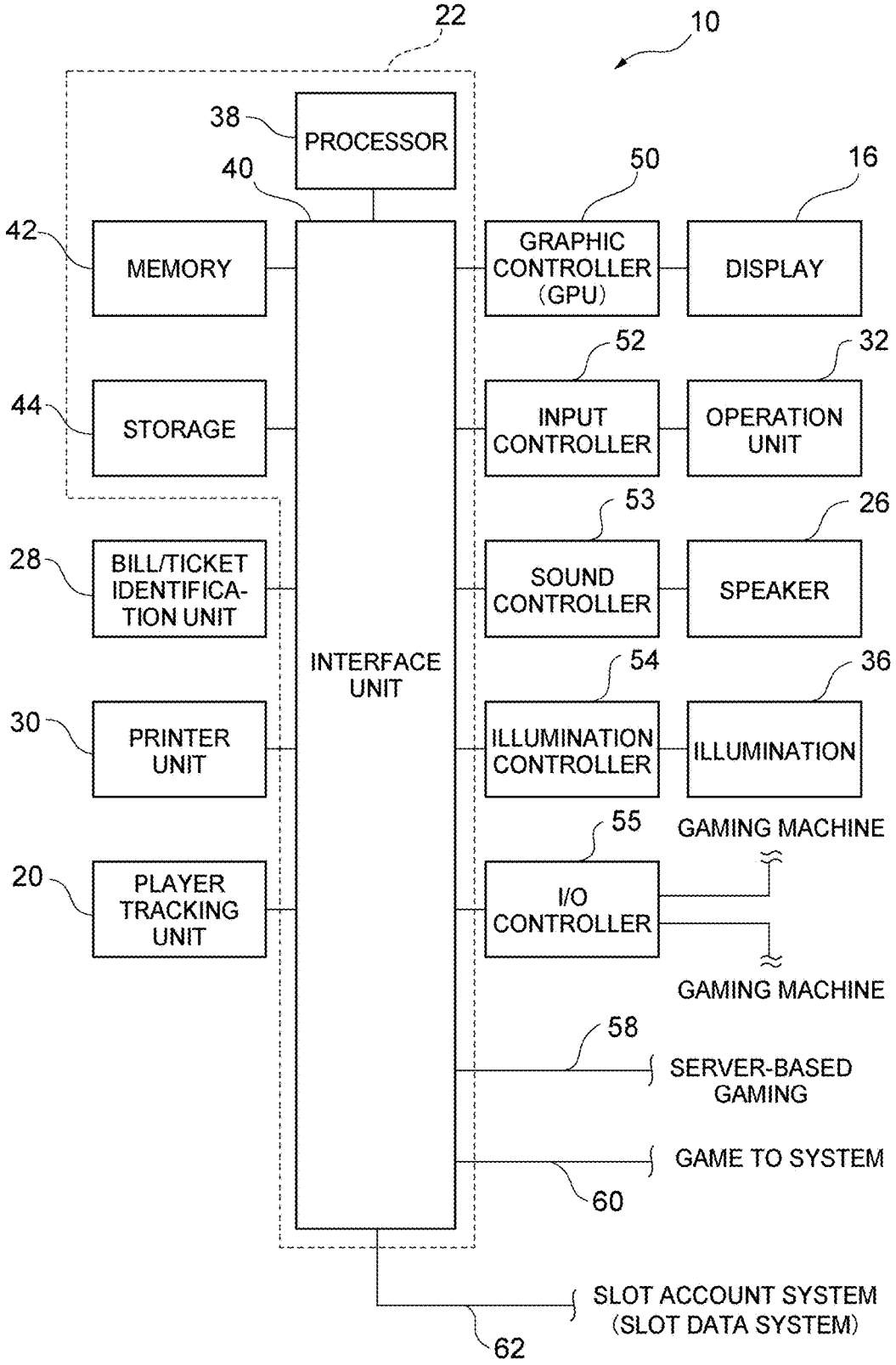
FIG. 3 is a block diagram illustrating an example of a configuration of a gaming machine.

FIG. 3 is a block diagram illustrating an example of a configuration of the gaming machine. The gaming machine 10 includes the controller 22. The controller 22 includes a processor 38 such as a CPU, an interface unit 40, a memory 42 (an example of a storage device), and a storage 44 (an example of a storage device). The controller 22 can be accommodated in the cabinet 12 as a control board. The controller 22 is configured to be able to communicate with each unit via the interface unit 40, and executes a program recorded in the memory 42 or the storage 44 of the processor 38 to control an operation of each unit such that the game is provided to the player.

The interface unit 40 includes a chip set that provides a communication function of the processor 38 such as a memory bus connected to the processor 38, various types of expansion buses, a serial interface, a USB interface, or an Ethernet (registered trademark) interfaces.

The memory 42 can be configured to include a RAM which is a volatile storage medium, a ROM which is a non-volatile storage medium, and an EEPROM which is a rewritable non-volatile storage medium. The storage 44 provides the controller 22 with a function of an external storage device, and a reading device such as a memory card which is a removable storage medium or a magneto-optical disk can be used, or a hard disk can be used.

The bill/ticket identification unit 28, the printer unit 30, the player tracking unit 20, a graphic controller (GPU) 50, an input controller 52, a sound controller 53, an illumination controller 54, and an I/O controller 55 are connected to the interface unit 40. The graphic controller 50, the input controller 52, the sound controller 53, the illumination controller 54, and the I/O controller 55 can be accommodated in the cabinet 12 as a control board.

The controller 22 is connected to the display 16 via the graphic controller 50. The controller 22 is connected to the operation unit 32 via the input controller 52. The controller 22 is connected to the illumination 36 via the illumination controller 54.

The controller 22 executes a program stored in the memory 42 or the storage 44 to control each part such that the game is provided to the player. Here, for example, an operating system and a sub system program that provide the basic functions of the controller 22 and data may be stored in an EEPROM of the memory 42, and a program and data of an application that provides the game may be stored in the storage 44. With such a configuration, it is possible to easily change or update the game by replacing the storage 44. Further, the controller 22 may have a multi-processor configuration including a plurality of CPUs.

The respective blocks connected to the controller 22 will be described below. The bill/ticket identification unit 28 receives the bill/ticket through the insertion slot, and notifies the controller 22 of identification information corresponding to a bill type or a credit payout process. The controller 22 increases a credit amount usable in the game in accordance with the notification content. The printer unit 30 prints information corresponding to the credit payout process from the gaming machine 10 on the ticket under the control of the controller 22 that receives an operation of a payout button included in the operation unit 32, and outputs it.

The player tracking unit 20 operates in cooperation with the controller 22 and performs transmission and reception of player information with a casino management system. The graphic controller 50 controls the display 16 under the control of the controller 22 such that a display image including various types of graphic data is displayed. The sound controller 53 drives the speaker 26 under the control of the controller 22 and provides various types of sounds such as an announcement, a sound effect, and a BGM. The illumination controller 54 controls lighting of the illumination 36 under the control of the controller 22.

Figure 4:
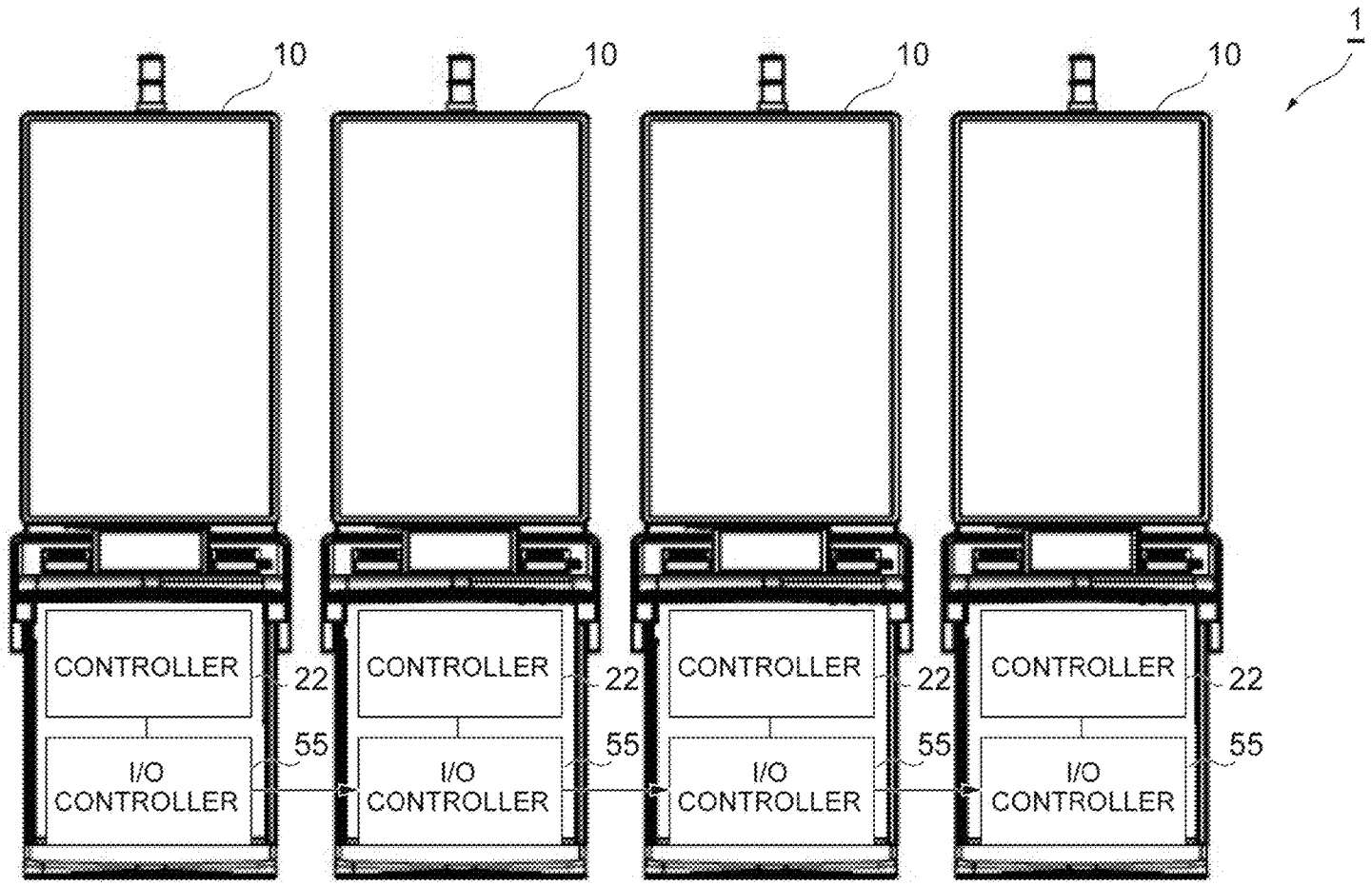
FIG. 4 is a configuration diagram illustrating an example of a connection of gaming machines constituting a gaming machine group.

The I/O controller 55 operates in cooperation with the controller 22 and realizes a communicable connection with other gaming machines. FIG. 4 is a configuration diagram illustrating an example of a connection of the gaming machines constituting the gaming machine group. As illustrated in FIG. 4, the respective gaming machines 10 are connected by the I/O controllers 55 via daisy chains. The gaming machine 10 at the top of the daisy chain connection is set as the master, and the other gaming machines 10 are set as the slave.

The plurality of gaming machines 10 that constitute the gaming machine group 1 communicate with other gaming machines included in the gaming machine group 1 and cause timer values to be synchronized. The master controller 22 outputs a reset signal to the nearest slave I/O controller 55 via the I/O controller 55. The reset signal is a signal for performing synchronization within the gaming machine group 1, and for example, a pulse signal can be used. The slave I/O controller 55 that has received the output reset signal outputs the reset signal to the next slave I/O controller 55 located downstream. As described above, the reset signal issued by the master are propagated to all the slaves in order. Each of the gaming machines 10 constituting the gaming machine group 1 resets the timer value on the basis of the reset signal. Accordingly, the timer values of the respective gaming machines 10 are synchronized. Hereinafter, the synchronized timer value is also referred to as a common timer. The plurality of gaming machines 10 can operate in synchronization with one another using the common timer of each gaming machine 10.

Each of the slave I/O controllers 55 may generate a machine ID on the basis of the reset signal. The machine ID is an identifier which is assigned to each gaming machine 10 and is an identifier for determining a position of its own gaming machine in the gaming machine group 1 which is counted from the master (first). For example, the machine ID of the master is "0," the machine ID of the slave to which the reset signal is input first is "1," the machine ID of the slave to which the reset signal is input next is "2," and the machine ID of the slave to which the reset signal is input next is "3." The machine ID may be a fixed identifier which is assigned to the gaming machine 10 in advance.

Returning to FIG. 3, the interface unit 40 includes various types of communication interfaces for communicating with the outside of the gaming machine 10. As an example, the interface unit 40 can communicate with an external network via the Ethernets 58 and 60 and the serial interface 62. FIG. 3 illustrates an example of performing communication with each of a well-known server-side gaming network (server-based gaming), G2S network (between game systems), and a slot information system (a slot data system).

Figure 5:
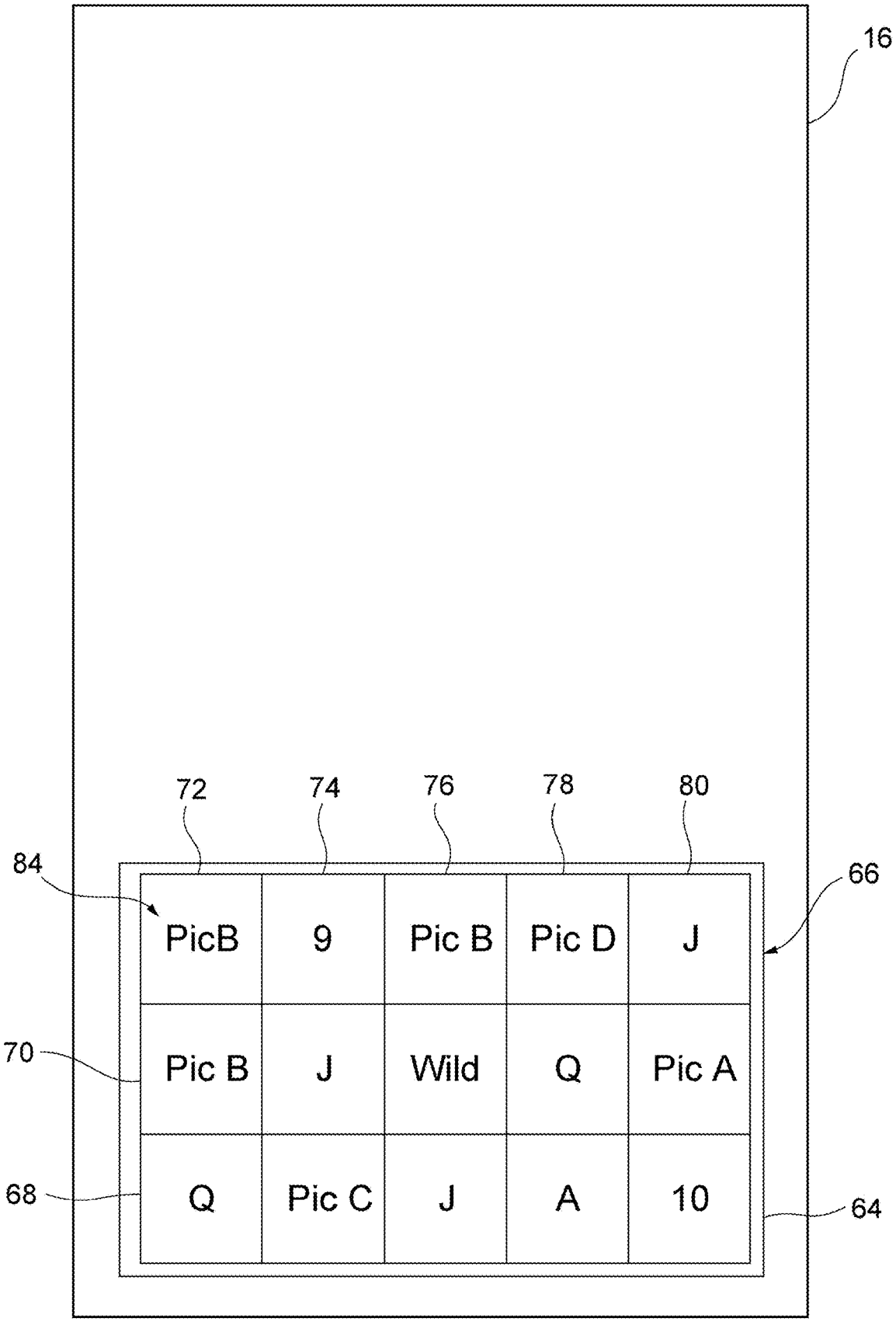
FIG. 5 is a schematic diagram illustrating an example of a game screen of the gaming machine of FIG. 2.

FIG. 5 is a schematic diagram illustrating an example of the game screen of the gaming machine of FIG. 2. As illustrated in FIG. 5, a game screen having a display area 64 for displaying a slot game is displayed on the display 16 by the controller 22 executing a predetermined program. The display area 64 is displayed in an area below the game screen as an example. In the game screen other than the display area 64, a screen display of game information, an animation, or the like is performed.

The display area 64 includes a grid 68 for displaying symbols. By using such a display area, the gaming machine 10 operates as a slot machine that performs winning determination in accordance with a combination of symbols displayed in the display area 64 and pays a dividend.

The display 16 displays a plurality of symbols on the grid 68. The grid 68 includes a plurality of rows and a plurality of columns. The grid 68 is configured with a plurality of cells 70 which are symbol stop positions. FIG. 5 illustrates a game screen with a plurality of cells arranged in a form of a 3□5 grid. The number of rows or the number of columns in the grid is not particularly limited and may be 3-4-4-4-3. One symbol is stopped and displayed on each of the plurality of cells 70 in the display area 64.

Figure 6:
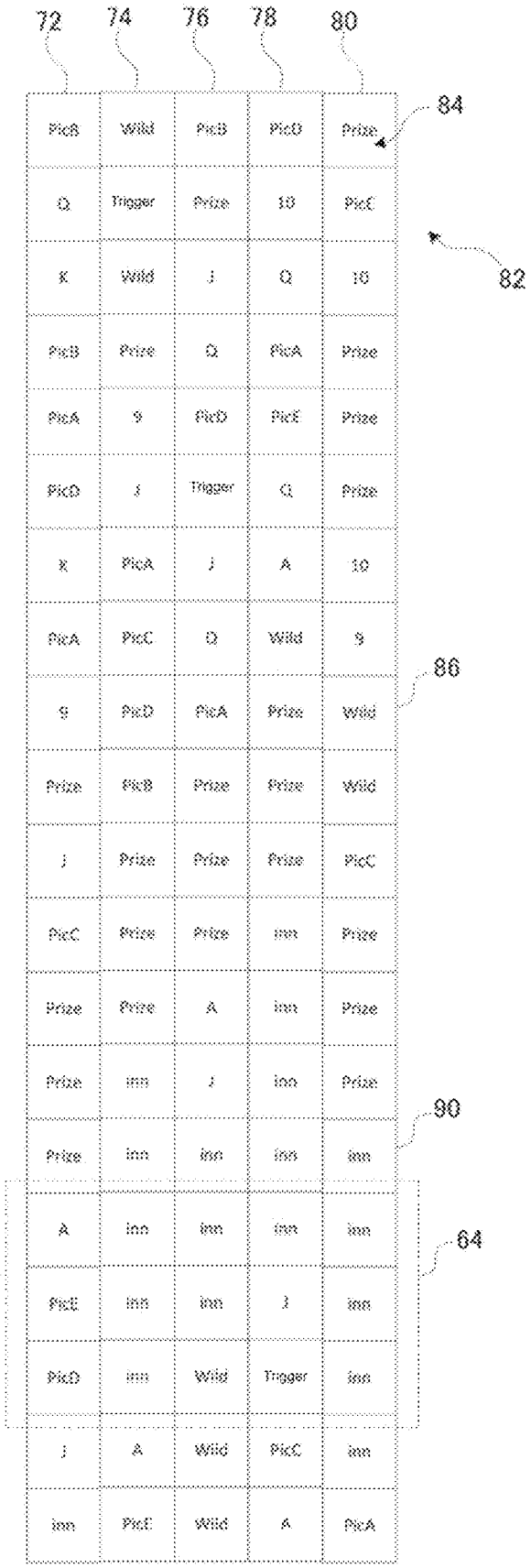
FIG. 6 is a diagram illustrating an example of a virtual reel strip including a symbol array indicating an order of symbols displayed in a display area.

The symbol arranged in each of the plurality of cells 70 is determined using a virtual reel strip. FIG. 6 is a diagram illustrating an example of a virtual reel strip including a symbol array indicating an order of the symbols displayed in the display area. As illustrated in FIG. 6, a symbol is displayed in each cell 70 of the grid 68 on the basis of a symbol array of a virtual reel 66 including virtual reel strips 72, 74, 76, 78, and 80 forming a virtual reel set 82. In other words, the cells 70 of the grid 68 are associated with the virtual reel strips 72 to 80 for each column, and the symbols arranged in predetermined portions of the virtual reel strips 72 to 80 are displayed. Further, as the respective symbols in each column are moved (scrolled or spun) on the basis of the symbol arrays of the virtual reel strip 72 to 80, the symbols displayed on the cells 70 of the grid 68 are changed, and the movement (scroll or spin) of each column is stopped, so that the symbols are stopped. Here, the virtual reel strips 72 to 80 are data, and the controller 22 uses a program included in the memory 42 or the storage 44 and data for displaying the symbol array adjusted for each cell column (that is, an alignment sequence of the symbols on each reel strip). Further, the virtual reel set 82 is a general term for the virtual reel strips 72 to 80. Further, a plurality of virtual reel sets may be prepared in accordance with game content. For example, a virtual reel set used in a primary game may be distinct from a virtual reel set used in a bonus game or a free game.

Figure 7:
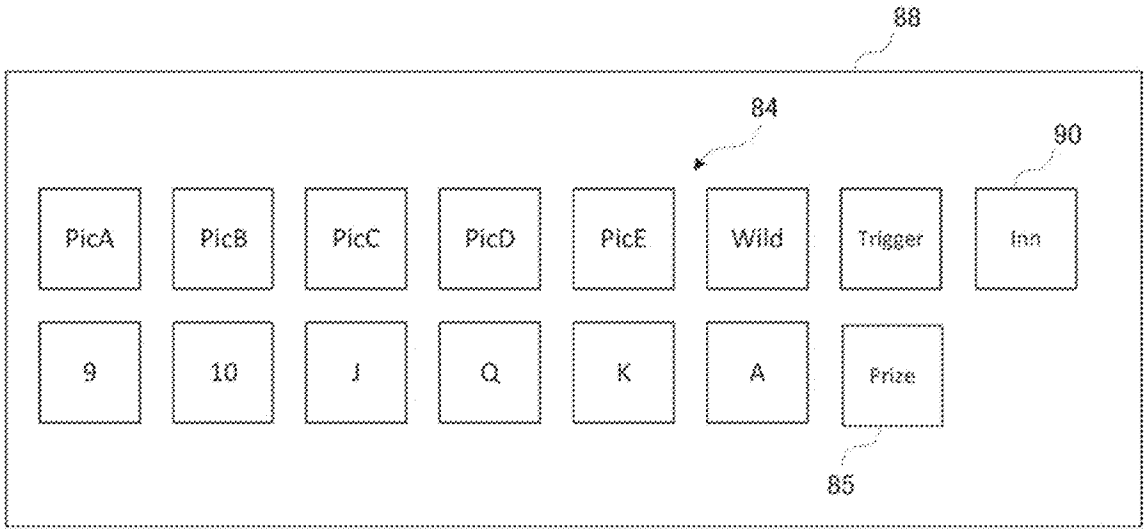
FIG. 7 is a diagram illustrating an example of a symbol displayed in a display area.

Each of the virtual reel strips 72 to 80 may include 20 symbols 84 in each symbol position 86, and these symbols are arranged in the order defined for each reel. FIG. 7 illustrates the symbols 84 illustrated in FIG. 6 in detail. Each of the virtual reel strips 72 to 80 includes symbols selected from the symbol set 88 of various types of symbol 84 illustrated in FIG. 7. The symbol set 88 includes card symbols ("9," "10," "J," "Q," "K," and "A") imitating a trap as standard symbols and image symbols ("PicA," "PicB," "PicC," and "PicD") representing patterns. Further, the symbol set 88 includes a wild symbol ("Wild") used as another symbol when a winning combination is determined and a trigger symbol ("Trigger") used for determining whether or not a game feature is provided. These symbols have different ranks for their values at the time of winning, and their ranks gradually increase in the order of "9," "10," "J," "Q," "K," "A," "PicE," "PicD," "PicC," "PicB," and "PicA." A combination of symbols including a symbol with a high rank at the time of winning can win a larger winning dividend than a combination of symbols with a low rank at the time of winning. The virtual reel set 82 further includes a plurality of credit winning symbols 85 ("Prize"). Each of the credit winning symbols 85 represents various credit amounts that can be given to the player during the game. Various types of credit amounts may include a credit number randomly selected from 10, 15, 20, 30, 60, 150, 350, 700, 1000, 1500, and 3000 credits for each game. Each credit number may be multiplied by a line-by-line bet at the start of each spin. In addition to the credit amount, the credit winning symbol may indicate a progressive bonus and/or a bonus game trigger that can be given to the player during the game.

Returning to FIG. 6, in one embodiment, some symbol positions may include fixed symbols, and the other symbol positions may include variable symbols represented by variable symbols 90 ("inn"). In an exemplary embodiment, for each game play, a fixed symbol position includes an associated predetermined symbol from a set of symbols 84, and the variable symbol 90 includes a symbol randomly selected from the symbol set 88.

The controller 22 starts the game and randomly determines the stop position of each of the virtual reel strips 72 to 80. The virtual reel strips 72 to 80 displayed on the display 16 move from the current position, stop on the basis of the stop position, and represent the result of the game. For this reason, in the display 16 or the grid 68, the symbols included in the virtual reel strips 72 to 80 are continuously moved (scrolled or spun) in the vertical direction of the display area 64, and one symbol of one cell 70 aligned in the symbol order on the basis of symbol array is stopped and displayed.

The controller 22 may vary and stop a plurality of symbols to be displayed on the display 16 in accordance with the operation of the player received by the operation unit 32, and the dividend may be paid in accordance with the symbols stopped in the display area 64.

Figure 8:
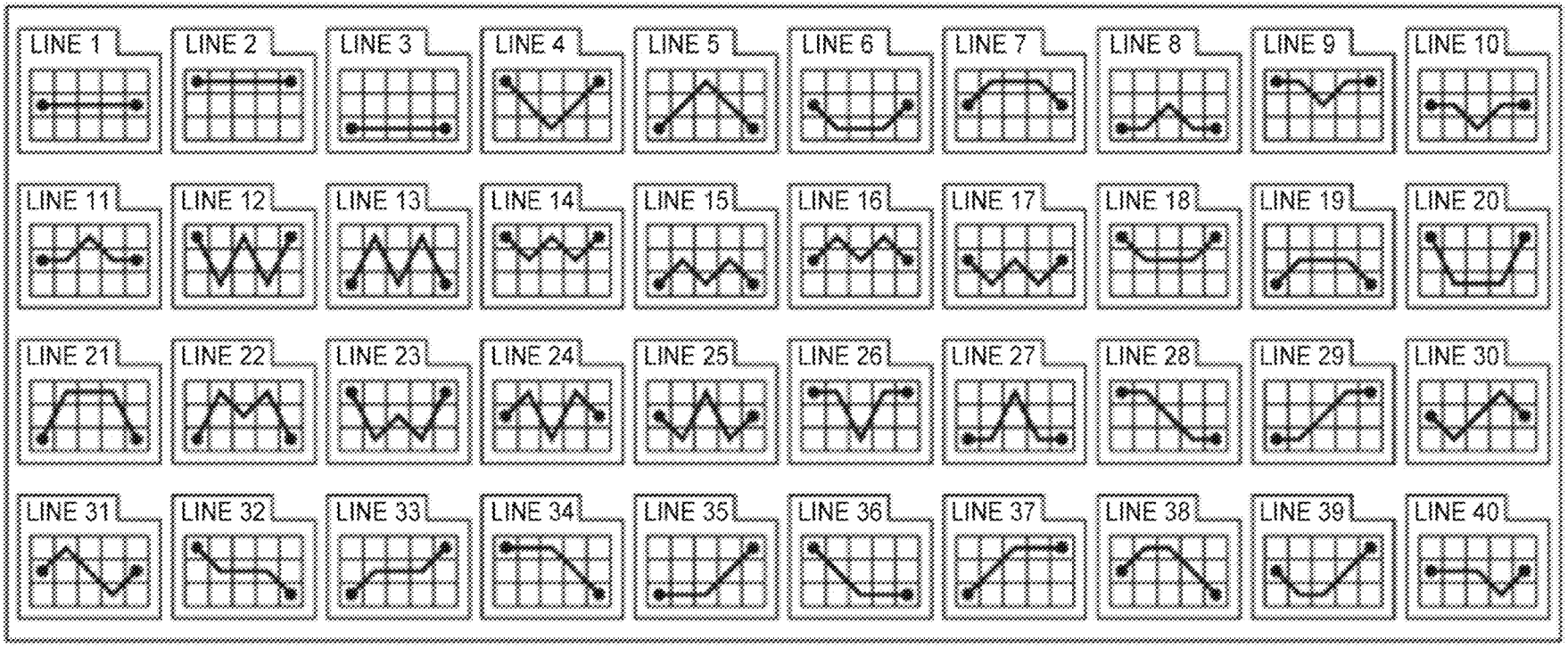
FIG. 8 is a diagram illustrating an example of a payline set in the display area of FIG. 5.

In the display area 64, a payline is set and used when winning is determined. The payline is a line which is set to extend from the cells in the leftmost column to the cells in the rightmost column and is used to determine winning in accordance with a combination of the plurality of cells 70. The number of effective lines in the set payline is selected by operating a group of line designation buttons included in a group of setting buttons of the operation unit 32 for the player. The controller 22 determines winning when the same symbols exceeding a predetermined number are aligned on the set payline as the result of the game that is a combination of symbols, and pays the dividend to the player in accordance with a type of symbol and the number of symbols. FIG. 8 is a diagram illustrating an example of the payline set in the display area 64 of FIG. 5. As illustrated in FIG. 8, in the gaming machine 10, a predetermined number of paylines (40 pattern lines) can be set in cells of 3 rows and 5 columns in the display area 64. A system for determining winning may determine winning when a predetermined number of same symbols are aligned from the cells in the leftmost column on the set payline, may determine winning when a predetermined number of same symbols are aligned from the cells in the rightmost column on the set payline, or may determine winning when a predetermined number of same symbols are aligned in consecutive columns on the set payline. Further, "Triggers" which are more than a predetermined number form a winning combination or a trigger condition regardless of the payline.

Figure 9:
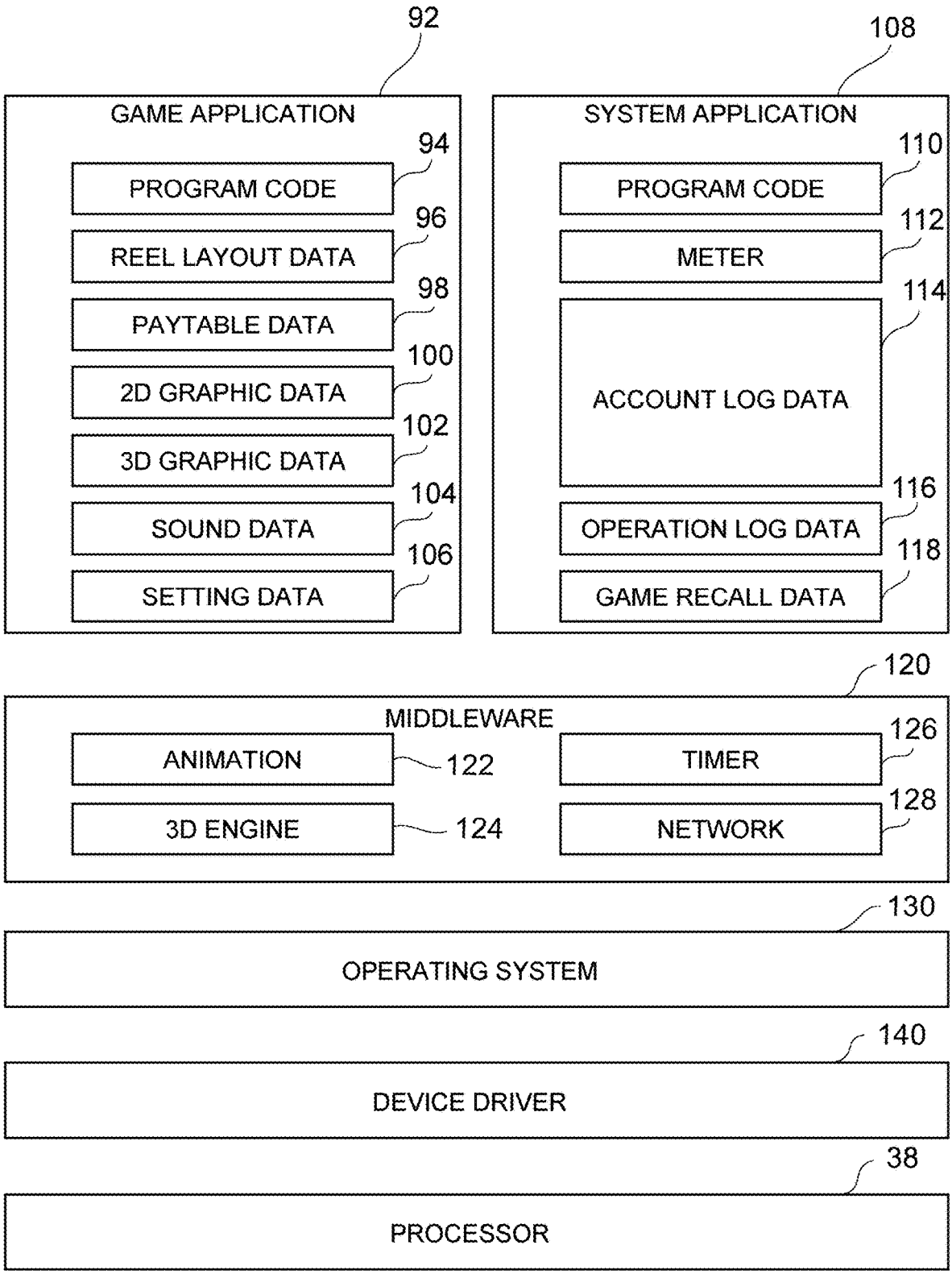
FIG. 9 is a block diagram illustrating an example of software and data of a gaming machine.

FIG. 9 is a block diagram illustrating an example of software and data of the gaming machine. The gaming machine 10 includes a game application 92 and a system application 108. The game application 92 and the system application 108 are stored, for example, in the memory 42. The game application 92 and the system application 108 are programs and include program codes 94 and 110 which are examples of computer executable commands. When executed by the processor 38, the program codes 94 and 110 cause the processor 38 to generate the game and the display 16 of the gaming machine 10 to display it. When executed by the processor 38, the game application 92 provides a game-dedicated/front-end function, and the system application 108 provides a general-purpose/back-end function.

The game application 92 and the system application 108 are implemented on the same operating system 130. These applications may be implemented on different operating systems or may be implemented by different processors.

The game application 92 includes data used when providing the game-dedicated/front-end function. As an example, the game application 92 includes reel layout data 96, paytable data 98, 2D graphic data 100, 3D graphic data 102, sound data 104, and setting data 106.

The reel layout data 96 is data including the virtual reel strip, and includes the virtual reel set 82 illustrated in FIG. 6 as an example. The paytable data 98 is a table in which a winning combination is associated with winning. The 2D graphic data 100 is two-dimensional graphic data to be displayed on the display 16. The 3D graphic data 102 is data for generating an image using a three-dimensional model. The 3D graphic data 102 includes common graphic data 1020. The common graphic data 1020 is data for displaying predetermined computer graphics cooperated with other gaming machines included in the gaming machine group 1, and is data which is commonly held in the gaming machines 10 that constitutes the gaming machine group 1. The common graphic data will be described later.

The sound data 104 is music data for a BGM and an event. The setting data 106 is a setting value used in the game application 92. The setting data 106 includes a machine ID set for each gaming machine 10. Further, the setting data 106 may include a total of the number of gaming machines 10 constituting a group of gaming machines. For example, content of the setting data 106 can be set by a worker when the gaming machine 10 is installed in a casino facility. It is desirable for the worker to change the settings in accordance with a new arrangement when the arrangement of the gaming machines 10 in the casino facility is changed. Further, as illustrated in the drawing, in the present embodiment, the setting data 106 is held in the game application 92, but the setting data 106 may be held in the system application 108. In a case in which a plurality of game applications 92 are installed in the gaming machine 10, the setting data 106 can be changed for each game application 92 by causing the game application 92 side to hold the setting data 106.

Accordingly, it is possible to cause each game application 92 to perform the cooperative operation in a different manner. On the other hand, in a case in which it is held on the system application 108 side, the setting data 106 may be shared by the plurality of game applications 92. In this case, it is possible to cause the plurality of game applications 92 to perform the cooperative operation in the same manner.

The system application 108 includes a meter 112, account log data 114, operation log data 116, game recall data 118. The meter 112 includes a credit meter to indicate a current credit balance of the gaming machine 10 and a winning meter to indicate a total of the number of winnings in a current game session. The meter 112 further includes a background meter such as a coin input, a coin return, a total drop, a jackpot paid by a customer service, and/or a bill input. These meters may be implemented as data on a non-volatile memory or as a hardware meter. The account log data 114 is cumulative data including an error event, a bill log, a cash withdrawal log, a ticket log, or the like. The operation log data 116 is log data of the gaming machine 10. The game recall data 118 is cumulative data including bonus results of a primary game and a free game. The game recall data 118 can be stored in a non-volatile memory.

The game application 92 and the system application 108 can be implemented on the same operating system 130. However, these applications may be implemented on different operating systems or on different processors.

Middleware 120 may be used to implement the game application 92 and the system application 108 in the operating system 130. In the configuration illustrated in FIG. 9, software modules of an animation 122, a 3D engine 124, a timer 126, and a network 128 are used as the middleware 120. The animation 122 and the 3D engine 124 are software modules used to generate 3D graphics and an animation thereof. The timer 126 is a software module for managing a timer. A common timer is generated by the timer 126. The network 128 is a software module used when communicating with other gaming machines 10 and the like.

A device driver 140 can be used to enable the operating system 130 to recognize and use devices installed in the gaming machine 10 or externally attached to the gaming machine 10. The device driver 140 may be installed in the operating system 130 or may be externally attached to the operating system 130.

The game application 92 and the system application 108 are not limited to the above-described program and data and may include additional programs and data to implement arbitrary functions such as execution and management of games.

Figure 10:
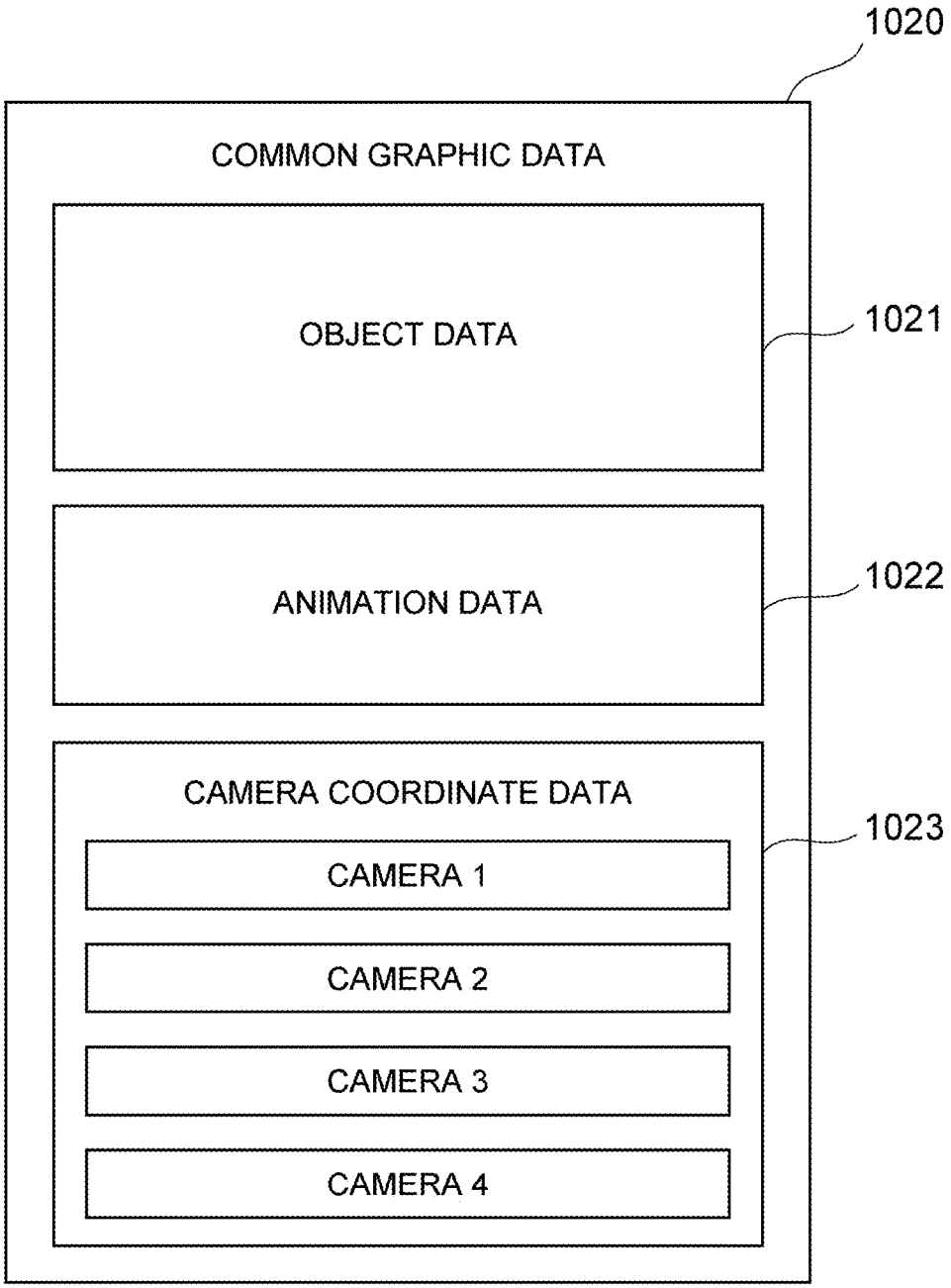
FIG. 10 is a block diagram illustrating an example of common graphic data.

FIG. 10 is a block diagram illustrating an example of the common graphic data. As illustrated in FIG. 10, the common graphic data 1020 includes object data 1021, animation data 1022, and camera coordinate data 1023 (an example of a plurality of virtual camera coordinates).

The object data 1021 is a three-dimensional model and is stereoscopic model data of an object to be displayed on the display 16. A desired object according to a design of a game can be used as the object stored as the object data 1021, and for example, the object stored as the object data 1021 may be a character such as an animal, a person, or a dragon or may be a structure such as a vehicle or a building or a plant such as a flower or a tree. Further, the object stored as the object data 1021 may be an object such as an article or an accessory used in a casino game such as a card game table, a craps table, a roulette, a wheel, a card, a ball, a dice, or a chip. The three-dimensional model may include a polygon serving as a three-dimensional appearance and a rig serving as its skeleton.

The animation data 1022 is data for setting a motion of the three-dimensional model. For example, the animation data 1022 is data indicating how the rig of the three-dimensional model moves. It is possible to give a motion to a character with reference to the animation data 1022.

The controller 22 constructs a three-dimensional model in common with the other gaming machines included in the gaming machine group 1 on the basis of the common timer and the object data 1021 via the game application 92. Then, the controller 22 arranges the three-dimensional model in a three-dimensional virtual space, and gives a motion to the three-dimensional model on the basis of the common timer and the animation data 1022.

The camera coordinate data 1023 is coordinate data of a virtual camera arranged in a three-dimensional virtual space. The camera coordinate data 1023 is associated with each machine ID that can be assigned to the gaming machine 10. The camera coordinate data 1023 can be prepared corresponding to the number of gaming machines 10 constituting the gaming machine group 1. In the example of FIG. 10, the camera coordinate data of each of the four cameras is stored in association with the four gaming machines 10 constituting the gaming machine group 1 illustrated in FIG. 1. For example, the camera coordinate data may be configured as a camera coordinate data set that is selected in accordance with the number of gaming machines 10 constituting the gaming machine group 1. Also, it is possible to employ a configuration of calculating each piece of camera coordinate data 1023 using a predetermined calculation formula on the basis of the number of gaming machines 10 constituting the gaming machine group 1 and the machine ID and using it.

The controller 22 performs perspective transformation on the three-dimensional model using a position indicated by the camera coordinate data 1023 in a three-dimensional space as a point of view via the game application 92. For example, the position indicated by the camera coordinate data 1023 is set as the point of view, and a projection plane is set at a position away from the point of view by a focal length in a line-of-sight direction. The controller 22 constructs predetermined computer graphics by perspective-projecting the three-dimensional model on the projection plane.

The camera coordinate data 1023 may be associated with a setting parameter of the virtual camera. The setting parameter of the virtual camera may include a position of a point of regard (the line-of-sight direction), a focal length, an output resolution, or the like. The controller 22 can set a photographing direction or a magnifying power arbitrarily by using the setting parameter.

Further, the camera coordinate data 1023 may be configured to change the position of each of the virtual camera coordinates without changing a relative position between a plurality of virtual camera coordinates. In this case, the camera coordinates associated with the identifier assigned to the gaming machine 10 are moved while maintaining a predetermined positional relation with the virtual camera coordinates associated with the identifiers assigned to the other gaming machines included in the gaming machine group 1. Accordingly, since the controller 22 can realize an arbitrary camera work in a state in which the motions of a plurality of virtual cameras are synchronized, it is possible to display a dynamic scene.

Figure 11:
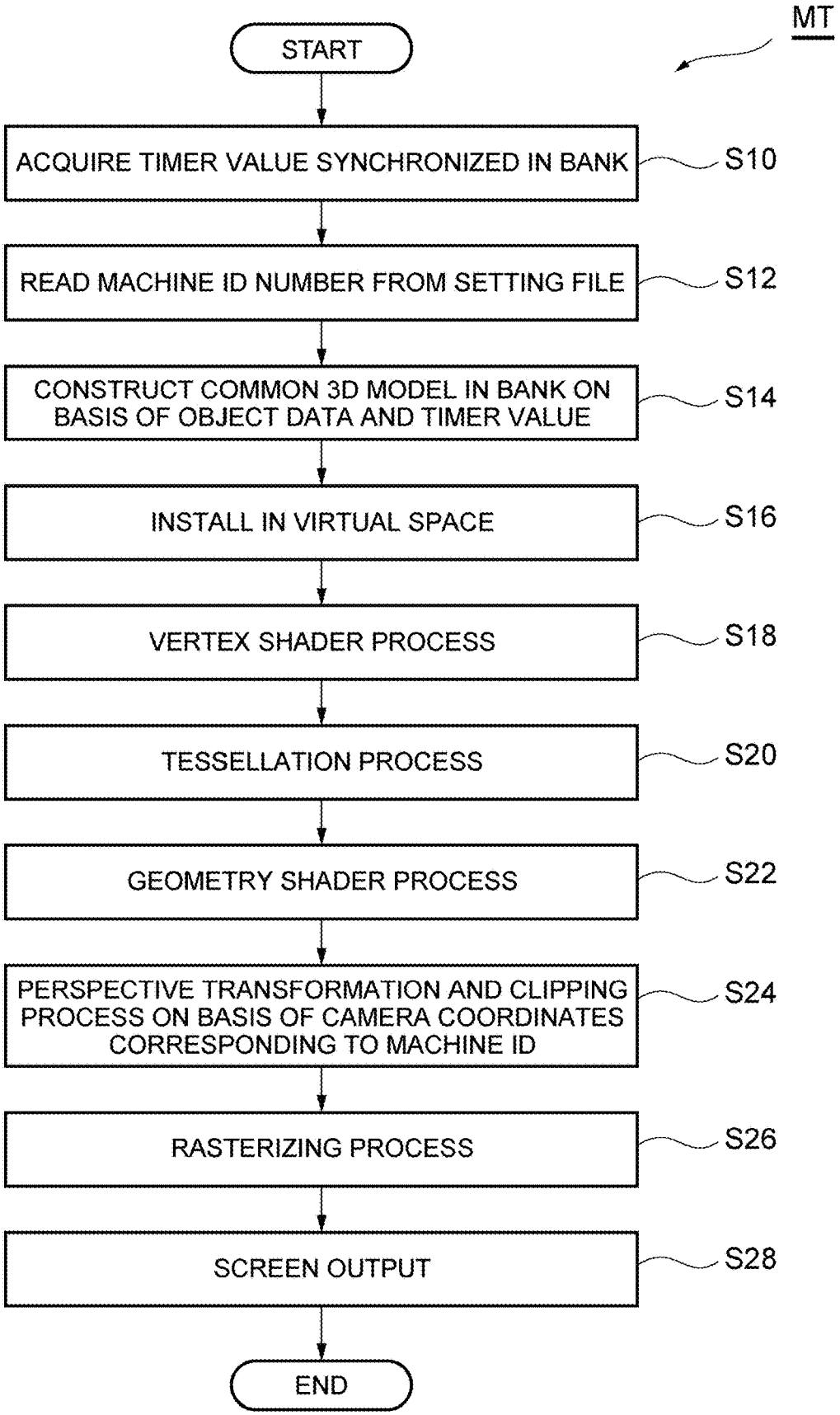
FIG. 11 is a flowchart describing an algorithm (method) used during a gaming machine operation.

FIG. 11 is a flowchart describing an algorithm (method) used during the gaming machine operation. A method MT illustrated in FIG. 11 is executed when the controller 22 executes the game application 92. For example, the method MT is executed when the gaming machines 10 constituting the gaming machine group 1 do not provide a game. An example in which the gaming machine group 1 includes the four gaming machines 10 will be described below as an example. The method MT is executed by each of the four gaming machines 10 constituting the gaming machine group 1.

As illustrated in FIG. 11, the controller 22 acquires a timer value synchronized in a bank via the I/O controller 55 and the timer 126 (step S10). In a case in which the gaming machine 10 is the master, the timer 126 resets the timer value using the reset signal issued by itself. In a case in which the gaming machine 10 is the slave, timer 126 resets the timer value using the reset signal issued by the master.

Then, the controller 22 reads the machine ID from the setting data 106 (step S12). In a case in which the gaming machine 10 is the master, the setting data 106 stores, for example, "0" as the machine ID. In a case in which the gaming machine 10 is the slave, the setting data 106 stores, for example, one of "1," "2," and "3" as the machine ID.

Then, the controller 22 constructs a common three-dimensional model in the bank on the basis of the object data 1021 and the timer value obtained in step S12 (step S14). As an example, the controller 22 constructs a dragon character as the three-dimensional model. The controller 22 may give a motion to the three-dimensional model on the basis of the animation data 1022 and the timer value.

Figure 12:
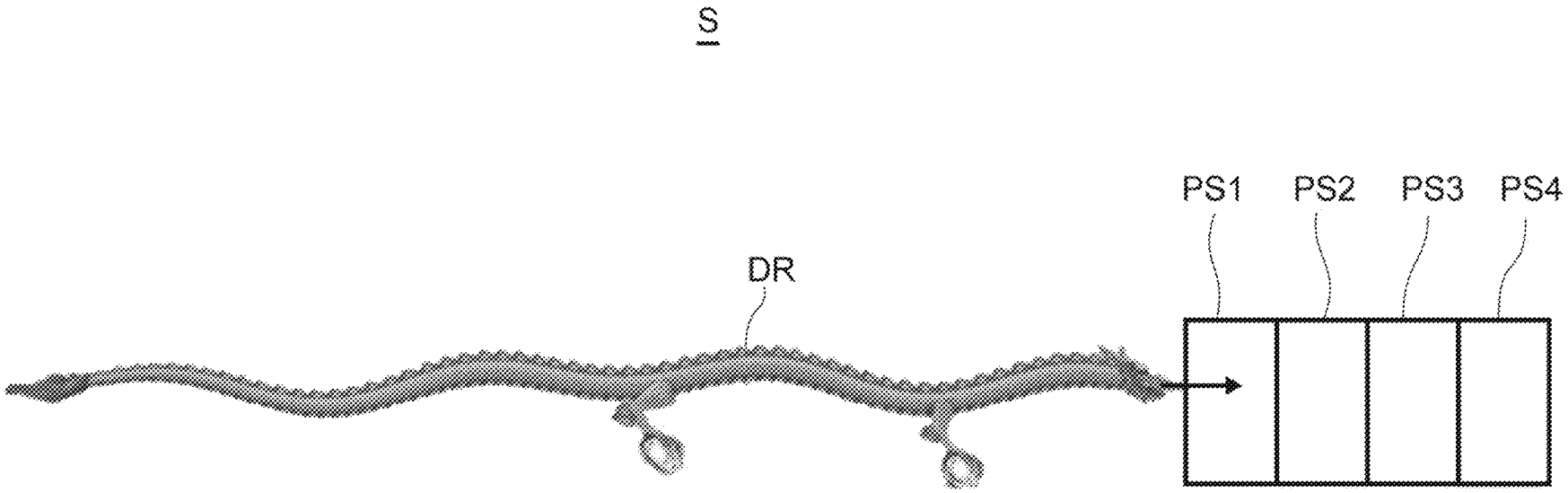
FIG. 12 is an example of a three-dimensional model placed in a virtual space.

Then, the controller 22 arranges the three-dimensional model in the virtual space (step S16). The controller 22 specifies the arrangement position of the three-dimensional model on the basis of the animation data 1022 and the timer value, and arranges the three-dimensional model. FIG. 12 is an example of the three-dimensional model arranged in the virtual space. As illustrated in FIG. 12, a dragon DR is arranged in a virtual space S.

Then, the controller 22 performs a vertex shader process with the graphic controller (GPU) 50 (step S18). The controller 22 performs coordinate transformation on each of attributes of vertices constituting the object of the three-dimensional model and adds a shadow.

Then, the controller 22 executes a tessellation process with the graphic controller (GPU) 50 (step S20). The controller 22 adjusts the resolution by increasing or decreasing the number of polygons in accordance with the distance to the object.

Then, the controller 22 executes a geometry shader process with the graphic controller (GPU) 50 (step S22). For example, the controller 22 increases or decreases the number of vertices in the object.

Figure 13:
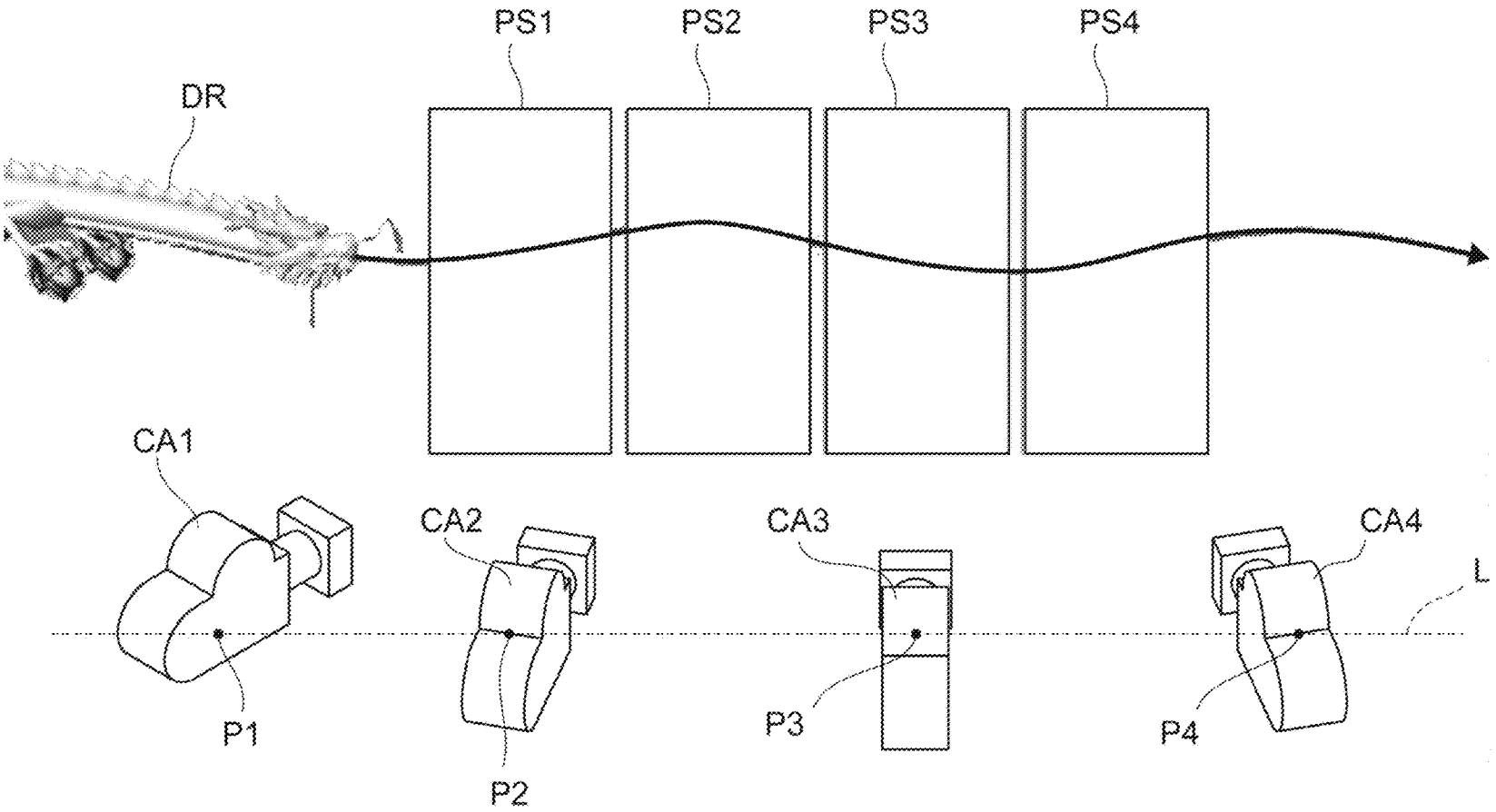
FIG. 13 is a diagram illustrating a relation between a three-dimensional model and projection planes corresponding to respective gaming machines.

Then, the controller 22 performs perspective transformation with the graphic controller (GPU) 50 on the basis of the camera coordinates corresponding to the machine ID, and executes a clipping process (step S24). As illustrated in FIG. 12, projection planes PS1 to PS4 corresponding to the camera coordinate data 1023 are set in the virtual space S. FIG. 13 illustrates a relation between the three-dimensional model and the projection planes corresponding to the respective gaming machines. As illustrated in FIG. 13, coordinate P1 corresponding to a virtual camera CA1, coordinate P2 corresponding to a virtual camera CA2, coordinate P3 corresponding to a virtual camera CA3, coordinate P4 corresponding to a virtual camera CA4 are stored in the memory 42 as the camera coordinate data 1023. The coordinates P1 to P4 are located on the same straight line L in the virtual space S. The coordinates P1 to P4 are located on the same straight line L at equal intervals. The projection planes PS1 to PS4 having the coordinates P1 to P4 associated with the machine ID as the point of view are configured to be adjacent to each other in the virtual space S. Further, the coordinates of the virtual camera and the projection plane position described above are examples, and the coordinates of the virtual camera and the projection plane position may be set arbitrarily.

Here, the coordinate P1 of the virtual camera CA1 is associated with the machine ID "0," the coordinate P2 of the virtual camera CA2 is associated with the machine ID "1," the coordinate P3 of the virtual camera CA3 is associated with the machine ID "2," and the coordinate P4 of the virtual camera CA4 is associated with the machine ID "3." In a case in which the machine ID obtained in step S12 is "1," the controller 22 projects the three-dimensional model onto the projection plane PS2 using the coordinate P2 corresponding to the machine ID "1" as the point of view. The controller 22 clips the obtained two-dimensional projection image with a predetermined size.

Then, the controller 22 performs a rasterizing process with the graphic controller (GPU) 50 (step S26). The controller 22 breaks down the polygon of the clipped projection image into pixels.

Finally, the controller 22 outputs an image via the graphic controller (GPU) 50 (step S28).

Figure 14:
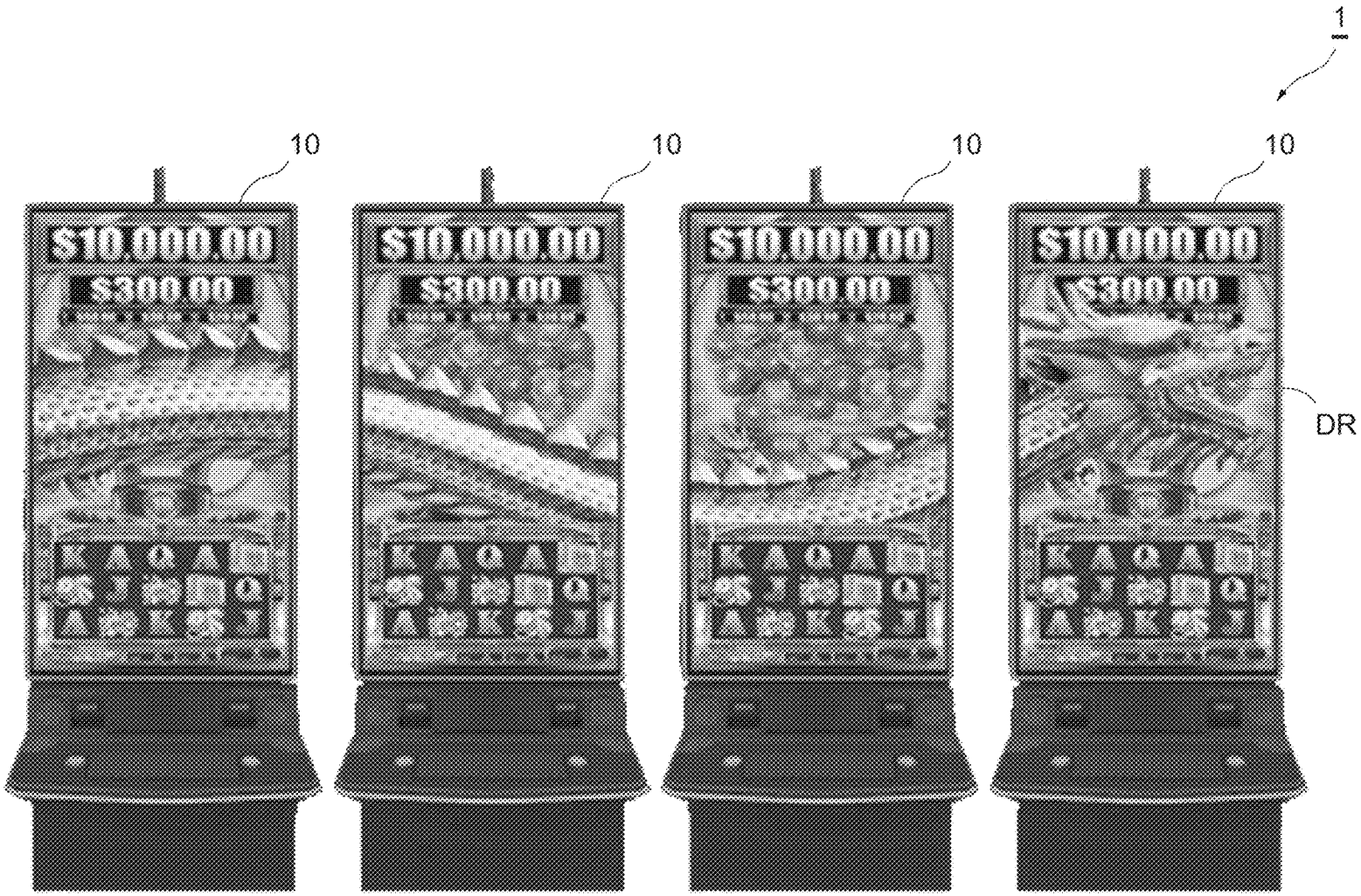
FIG. 14 is a diagram illustrating an example of a screen display related to an integrated operation.

Then, a series of processes ends. As each of the controllers 22 of the gaming machines 10 constituting the gaming machine group 1 executes the method MT, the dragon DR that is the same 3D object (the subject for each of the virtual cameras CA1 to CA4) is displayed on each of the displays 16 from the point of view of each of the gaming machines 10. Each of the controllers 22 of the gaming machines 10 constituting the gaming machine group 1 may repeatedly execute the method MT at a predetermined cycle. Accordingly, an image frame is generated at a predetermined cycle, and the dragon DR with the motion can be displayed in each of the gaming machines 10 in the cooperative manner. FIG. 14 is a diagram illustrating an example of a screen display related to the integrated operation. As illustrated in FIG. 14, the four gaming machines 10 can display one dragon DR moving across the gaming machines 10 from left to right.

As described above, according to the gaming machine 10 according to the present embodiment, the common dragon DR in common with the other gaming machines included in the gaming machine group 1 is constructed on the basis of the timer value synchronized by communicating with the other gaming machines included in the gaming machine group 1 and the common graphic data 1020 stored in the memory 42. Further, the computer graphics cooperated with the other gaming machines included in the gaming machine group 1 are configured by performing the perspective transformation on the three-dimensional model using the coordinates of the virtual camera associated with the machine ID assigned to the gaming machine 10 as the point of view and displayed on the display 16. As described above, the same scene as the scenes displayed on the displays 16 by the other gaming machines is displayed temporally and spatially in cooperation with the other gaming machines from a different point of view from those of the other gaming machines. In other words, the display can be performed as if the display 16 of the gaming machine 10 were linked with the displays of the other gaming machines. For this reason, it is possible to display a powerful scene straddling the display 16 of the gaming machine 10 and the displays of the other gaming machines. Therefore, the gaming machine 10 can perform the screen display related to the integrated operation in cooperation with a plurality of the gaming machines. Further, the gaming machine 10 can provide the player with experience with a high degree of satisfaction by performing the integrated operation in cooperation with a plurality of the gaming machines. Further, according to the present embodiment, the large screen display can be performed by using the displays 16 of a plurality of the gaming machines 10 in an integrated manner. In order to attach a large display to the gaming machine, in addition to the cost, proportionate work man hours are required even in loading/unloading and installation of equipment, but according to the present embodiment, the large screen display can be realized with minimum cost and man hours. Further, as the gaming machines that form a row of banks in the casino facility perform the screen display related to the integrated operation in cooperation with each other, it is possible to appeal the features that stand out in the casino facility to the player.

Also, when the dragon DR moving parallel to the same straight line L in the virtual space S is rendered, the distance from the point of view of the gaming machine 10 to the dragon DR and the distances from the points of view of the other gaming machines to the dragon DR can be set to be equal. Therefore, the gaming machine can display the dragon DR moving parallel to the same straight line L in cooperation with a plurality of the gaming machines 10.

Further, the gaming machines 10 are generally arranged at equal intervals. For this reason, the arrangement interval of the gaming machine 10 can be associated with the arrangement interval of the point of view in the virtual space S. Therefore, the gaming machine 10 can display the dragon DR more naturally when displaying the dragon DR moving parallel to the same straight line L in cooperation with a plurality of the gaming machines 10.

Further, the gaming machine 10 can perform the display as if the display 16 of the gaming machine 10 and the displays of the other gaming machines were one display. Accordingly, it is possible to display a powerful object straddling the display 16 of the gaming machine 10 and the displays of the other gaming machines.

The exemplary embodiments of the gaming machine, the gaming system, and the display method have been described above in detail. The gaming machine, the system, and the method are not limited to a specific embodiment described in this specification, but rather the components of the gaming machine and/or the system and/or the steps of the method may be used individually independently of the other component and/or step described in this specification. For example, the gaming machines may be used in combination with other gaming systems and methods and are not limited to the implementation using only the gaming machine described in this specification. Rather, the exemplary embodiments may be carried out and used in connection with applications of many other gaming systems.

For example, the gaming machine 10 that provides the game in the form of a slot machine has been described in the embodiment, but the present invention is not limited thereto, and the game may be provided in the form of a video card game called a poker, a blackjack, a bingo, a keno, a wheel game, or the like. Further, the present invention can be applied to pachinko machines or pachinko slot machines.

Also, the controller in this specification is not limited to a single processor, but can include a plurality of processors. In other words, the controller may be referred to as a controller including a GPU. For this reason, the method MT is executed by the controller 22 in the embodiment, but the process after step S18 may be executed by the graphic controller 50. Even in this case, the controller is regarded as executing the method MT.

Further, the connection between the gaming machines 10 is not limited to the connection by the I/O controller 55 and may be a connection using other devices. For example, the connection between the gaming machines 10 may be a connection in which the controllers 22 are connected in a serial manner or by an Ethernet. In this case, the connection form may be a topology of any one of a star type, a ring type, a bus type, and a mesh type, and the reset signal may be configured to be multicast or broadcast from the gaming machine 10 of the master. The connection between the gaming machines 10 can also be configured virtually on an existing gaming machine network. Moreover, various types of data held in the game application 92 may be synchronized by communication between the gaming machines 10.

Moreover, in the embodiment, the example in which the method MT is executed when the gaming machine 10 constituting the gaming machine group 1 does not provide the game has been described, but the present invention is not limited thereto, and the method MT may be executed when the plurality of gaming machines 10 among the gaming machines 10 constituting the gaming machine group 1 do not provide the game. For example, out of the four gaming machines 10, one gaming machine 10 may provide the game, and the method MT may be executed by the remaining three gaming machines 10.

A controller, a computing device, or a computer described in this specification includes at least one or more processors or processing units and a system memory. Commonly, the controller also includes at least a certain form of computer readable medium. Examples of the computer readable medium include, but are not limited to, a computer storage medium and a communication medium. The computer storage medium may include removable and non-removable volatile and non-volatile mediums which are implemented by an arbitrary method or technique for enabling storage of information such as a computer readable command, a data structure, a program module, or other data. The communication medium typically includes an arbitrary information delivery medium that embodies a computer readable command, a data structure, a program module, or other data through a modulated data signal such as a carrier wave or other transport mechanisms. A modulated data signal having one or more characteristics set or changed so that information is encoded into a signal would be understood by those skilled in the art. The arbitrary combination is also included within the scope of the computer readable medium.

The order in which an operation is performed or executed in the embodiment of the present invention illustrated and described in this specification is not mandatory unless otherwise specified. That is, the operation described in this specification may be performed in an arbitrary order unless otherwise specified, and the embodiment of the present invention may include operations more or less than the operations disclosed in this specification. For example, it is considered to be within the scope of aspects of the present invention to perform or execute a particular operation before, simultaneously with, or after another operation.

In some embodiments, as the processor described in this specification, an arbitrary programmable system including a system and a microcontroller, a reduced instruction set circuit (RISC), an application specific integrated circuit (ASIC), a programmable logic circuit (PLC), and an arbitrary other circuit or processor capable of executing a function described in this specification is included. The above examples are illustrative only and are therefore not intended to limit the definition and/or meaning of the term "processor."

In this specification, the examples including the best mode to disclose the present invention is used, and the example including the best mode in which those skilled in the art can implement the present invention in addition to manufacturing and using an arbitrary device or system and performing an arbitrary incorporated method is used. The patentable scope of the present invention is defined by claims set forth below and may include other examples that is conceivable by those skilled in the art. Other aspects and features of the present invention can be obtained from the review of the drawings, the disclosure, and the appended claims. The present invention may be implemented by a method other than those specifically set forth in the appended claims. It should also be noted that steps and/or functions described in the appended claims are not limited to a particular order of operations regardless of an order in which steps and/or functions are described.

The specific features of various embodiments of the present invention are illustrated in some drawings and may not be illustrated in other drawings, but this is for convenience only. On the basis of the principles of the present invention, an arbitrary feature of a drawing may be referenced and/or claimed in combination with an arbitrary feature of any other drawing.

Reference Signs List: 1: gaming machine group, 10: gaming machine, 16: display, 22: controller, 42: memory, 44: storage, 50: graphic controller, 55: 110 controller, 106: setting data, 1020: common graphic data, 1023: camera coordinate data, MT: method.

What is claimed is:

1. A gaming machine that constitutes a group of gaming machines that are communicably connected to each other, comprising:

a display configured to display a game screen including predetermined computer graphics cooperated with the other gaming machines included in the group of gaming machines;

a storage device configured to store an identifier assigned to the gaming machine, common graphic data for displaying the predetermined computer graphics, and a virtual camera coordinate associated with the identifier assigned to the gaming machine; and a controller connected to the display and the storage device, the controller including a processor programmed to execute an algorithm to render an animated sequence of computer-generated images on the display including the steps of:

rendering a plurality of virtual reels on a lower portion of the game screen;

constructing a three-dimensional character model in common with the other gaming machines included in the group of gaming machines on the basis of the common graphic data stored in the storage device;

performing perspective transformation on the three-dimensional character model using the virtual camera coordinates associated with the identifier assigned to the gaming machine as a point of view; and animating the three-dimensional character model to move across an upper portion of the display.

2. The gaming machine of claim 1, wherein the processor is programmed to execute the algorithm including the steps of:

resetting a timer value upon receiving a reset signal to synchronize the timer value with the other gaming machines; and constructing the three-dimensional character model based on the synchronized timer value and the common graphic data.

3. The gaming machine of claim 1, wherein the identifier assigned to the gaming machine indicates a relative position of the gaming machine within the group of gaming machines.

4. The system of claim 1, wherein the processor is programmed to execute the algorithm including the steps of animating the three-dimensional character model to facilitate an appearance of the three-dimensional character model moving across the group of gaming machines.

5. The gaming machine of claim 1, wherein the virtual camera coordinate is different than other virtual camera coordinates associated with the other gaming machines.

6. The gaming machine of claim 5, wherein the virtual camera coordinate is orientated at a predetermined positional relationship with the other virtual camera coordinates associated with the other gaming machines.

7. The system of claim 1, wherein the processor is programmed to execute the algorithm including the steps of performing the perspective transformation on the three-dimensional character model such that the point of view of the gaming machine to the three-dimensional character model is equal for each of the gaming machines.

8. A method of operating a gaming machine within a group of gaming machines, the gaming machine including a display configured to display a game screen including predetermined computer graphics cooperated with the other gaming machines included in the group of gaming machines, a storage device configured to store an identifier assigned to the gaming machine, common graphic data for displaying the predetermined computer graphics, and a virtual camera coordinate associated with the identifier assigned to the gaming machine, and a processor operably coupled to the display and the storage device, the method including the processor performing an algorithm to render an animated sequence of computer-generated images on the display including the steps of:

rendering a plurality of virtual reels on a lower portion of the game screen;

constructing a three-dimensional character model in common with the other gaming machines included in the group of gaming machines on the basis of the common graphic data stored in the storage device;

performing perspective transformation on the three-dimensional character model using the virtual camera coordinates associated with the identifier assigned to the gaming machine as a point of view; and animating the three-dimensional character model to move across an upper portion of the display.

9. The method of claim 8, including the processor performing the algorithm including the steps of:

resetting a timer value upon receiving a reset signal to synchronize the timer value with the other gaming machines; and constructing the three-dimensional character model based on the synchronized timer value and the common graphic data.

10. The method of claim 8, wherein the identifier assigned to the gaming machine indicates a relative position of the gaming machine within the group of gaming machines.

11. The method of claim 8, including the processor performing the algorithm including the steps of animating the three-dimensional character model to facilitate an appearance of the three-dimensional character model moving across the group of gaming machines.

12. The method of claim 8, wherein the virtual camera coordinate is different than other virtual camera coordinates associated with the other gaming machines.

13. The method of claim 12, wherein the virtual camera coordinate is orientated at a predetermined positional relationship with the other virtual camera coordinates associated with the other gaming machines.

14. The method of claim 8, including the processor performing the algorithm including the steps of performing the perspective transformation on the three-dimensional character model such that the point of view of the gaming machine to the three-dimensional character model is equal for each of the gaming machines.

15. A non-transitory computer-readable storage media having computer-executable instructions embodied thereon to operate a gaming machine within a group of gaming machines, the gaming machine including a display configured to display a game screen including predetermined computer graphics cooperated with the other gaming machines included in the group of gaming machines, a storage device configured to store an identifier assigned to the gaming machine, common graphic data for displaying the predetermined computer graphics, and a virtual camera coordinate associated with the identifier assigned to the gaming machine, and a processor operably coupled to the display and the storage device, when executed by the processor the computer-executable instructions cause the processor to perform an algorithm to render an animated sequence of computer-generated images on the display including the steps of:

rendering a plurality of virtual reels on a lower portion of the game screen;

constructing a three-dimensional character model in common with the other gaming machines included in the group of gaming machines on the basis of the common graphic data stored in the storage device;

performing perspective transformation on the three-dimensional character model using the virtual camera coordinates associated with the identifier assigned to the gaming machine as a point of view; and animating the three-dimensional character model to move across an upper portion of the display.

16. The non-transitory computer-readable storage media of claim 15, wherein the computer-executable instructions cause the processor to perform the algorithm including the steps of:

resetting a timer value upon receiving a reset signal to synchronize the timer value with the other gaming machines; and constructing the three-dimensional character model based on the synchronized timer value and the common graphic data.

17. The non-transitory computer-readable storage media of claim 15, wherein the identifier assigned to the gaming machine indicates a relative position of the gaming machine within the group of gaming machines.

18. The non-transitory computer-readable storage media of claim 15, wherein the computer-executable instructions cause the processor to perform the algorithm including the steps of animating the three-dimensional character model to facilitate an appearance of the three-dimensional character model moving across the group of gaming machines.

19. The non-transitory computer-readable storage media of claim 15, wherein the virtual camera coordinate is different than other virtual camera coordinates associated with the other gaming machines.

20. The non-transitory computer-readable storage media of claim 15, wherein the computer-executable instructions cause the processor to perform the algorithm including the steps of performing the perspective transformation on the three-dimensional character model such that the point of view of the gaming machine to the three-dimensional character model is equal for each of the gaming machines.

* * * * *